US011266992B2

(12) United States Patent
Wong et al.

(10) Patent No.: US 11,266,992 B2
(45) Date of Patent: Mar. 8, 2022

(54) TEST TUBE SUSPENDER

(71) Applicant: Board of Regents of the Nevada System of Higher Education on behalf of Nevada State College, Henderson, NV (US)

(72) Inventors: Aaron Wong, Henderson, NV (US); Brian Martinelli, Las Vegas, NV (US)

(73) Assignee: Board of Regents of the Nevada System of Higher Education on behalf of Nevada State College, Henderson, NV (US)

( * ) Notice: Subject to any disclaimer, the term of this patent is extended or adjusted under 35 U.S.C. 154(b) by 377 days.

(21) Appl. No.: 16/365,860

(22) Filed: Mar. 27, 2019

(65) Prior Publication Data

US 2019/0366347 A1 Dec. 5, 2019

Related U.S. Application Data

(60) Provisional application No. 62/680,635, filed on Jun. 5, 2018.

(51) Int. Cl.
*B01L 9/06* (2006.01)

(52) U.S. Cl.
CPC ..... *B01L 9/06* (2013.01); *B01L 2200/06* (2013.01); *B01L 2200/14* (2013.01); *B01L 2300/0832* (2013.01); *B01L 2300/18* (2013.01)

(58) Field of Classification Search
CPC ..... B01L 9/06
See application file for complete search history.

(56) References Cited

U.S. PATENT DOCUMENTS 3,443,396 A 5/1969 Ziolkowski et al.
5,375,716 A * 12/1994 Rubin ..... B01L 9/06 206/443
2006/0266719 A1 11/2006 Knight et al.
2010/0059461 A1 3/2010 Landsberger

FOREIGN PATENT DOCUMENTS

CN 204352905 U 5/2015

OTHER PUBLICATIONS

Written Opinion and Int'l Search Report issued in co-pending application No. PCT/US2019/025095, dated May 16, 2019.
Aug. 1, 2014, XPO55587050, Retrieved from the Internet: https://www.pacificlab.com.au/media/products/201251.pdf (retrieve on May 9, 2019, p. 3 bottom right figure).

* cited by examiner

*Primary Examiner* — Paul S Hyun
(74) *Attorney, Agent, or Firm* — Reising Ethington P.C.

(57) ABSTRACT

Disclosed is a test tube rack designed to hold a plurality of test tubes suspended in a bath. The rack is a unitary design having an outer rim with an internal diameter sized to fit over a rim of a vessel that forms the bath. The rack includes a plurality of openings sized to fit a test tube. A top end of each opening includes a plurality of raised portions and a plurality of lowered portions. The raised portions support an outwardly flared rim of a test tube placed in the opening and thus suspends the test tube in the vessel. A central hub joins the plurality of openings together. The rack is formed from a temperature resistant material and can be utilized with both cold and hot baths. The rack is economical and readily scalable to work in conjunction with a variety of vessel sizes.

17 Claims, 7 Drawing Sheets

TEST TUBE SUSPENDER

RELATED APPLICATIONS

This application claims the benefit of U.S. Provisional Application No. 62/680,635, filed Jun. 5, 2018.

STATEMENT REGARDING FEDERALLY SPONSORED RESEARCH

NONE.

STATEMENT REGARDING JOINT DEVELOPMENT AGREEMENT

NONE.

REFERENCE TO SEQUENCING LISTING, TABLE OR COMPUTER PROGRAM LISTING

NONE.

TECHNICAL FIELD

This disclosure relates generally to laboratory equipment and more particularly to a test tube rack for holding a plurality of test tubes suspended in a vessel such as a beaker.

BACKGROUND OF THE DISCLOSURE

This section provides background information which is not necessarily prior art to the inventive concepts associated with the present disclosure.

In laboratory settings it is often desirable to place a plurality of test tubes in a temperature controlled bath to either heat or cool the contents of the test tubes. The temperature of these baths can range from well below 0° C. to well above 100° C. and thus one needs to use a system that allows a user to avoid contact with the bath. The bath can be a task specific manufactured bath system or many times a user employs a vessel such as a beaker filled with a fluid to serve as the bath. The bath in the beaker can be cooled, for example with with ice or liquid nitrogen, or heated, for example by using a hot plate, a Bunsen burner or by other means. It is necessary many times to suspend the test tube in the bath for a period of time. One solution in the past has been the use of a test tube clamp to hold the test tube; however this is less than ideal for multiple reasons. First, the clamp only holds a single test tube at a time, preventing its use to simultaneously hold a plurality of test tubes. Second, when it is desirable to leave the test tube in the bath for a significant period of time the test tube clamp must be held by a user making long incubation times inconvenient. These clamps are prone to slippage and can be awkward to handle especially if multiple users are using the same bath. Other solutions have included use of test tube racks that either float in the bath or sink to the bottom of the bath neither of which is an ideal solution. Both of these rack systems are subjected to the same temperatures as the bath and thus handling these racks can also become a safety issue. Depending on the fluid in the bath these rack systems may need to be created from special materials to withstand the bath fluid. In a classroom setting it is often the case that multiple users are using the same bath and thus safety around the bath becomes an issue. In addition, the users may have to remove and replace the test tubes in the bath multiple times increasing the potential for accidents in the prior art systems.

It is desirable to provide a test tube rack that suspends a plurality of test tubes in a bath in a vessel and wherein the test tubes are easily and safely removable from the rack. It is desirable to provide such a rack that can be safely removed from a bath having a temperature of from less than 0° C. to greater than 100° C. It is desirable to provide such a rack wherein the rack itself is not located in the bath while holding the test tubes in the bath and wherein the test tubes can be uncovered and the bath fluid cannot enter the test tube. Finally, it is desirable to provide such a test tube rack that is economical to manufacture.

SUMMARY OF THE DISCLOSURE

This section provides a general summary of the disclosure and is not a comprehensive disclosure of its full scope or all features, aspects or objectives.

In general terms, this disclosure provides a test tube rack designed to suspend a plurality of test tubes in a bath in vessel. In one embodiment the invention comprises a test tube rack for suspending a plurality of test tubes inside a vessel comprising: a unitary structure including an outer rim and interior to the outer rim a plurality of openings, each of the plurality of openings sized to receive a test tube; the plurality of openings surrounding and connected to a central hub; each of the plurality of openings having a top end, said top end including at least one raised portion and at least one lowered portion; and the outer rim having an inner diameter permitting the outer rim to fit over a rim of a vessel, thereby allowing for suspension of a test tube received in one of the openings inside the vessel.

In another embodiment the invention is a test tube rack for suspending a plurality of test tubes inside a vessel comprising: a unitary structure including an outer rim and interior to the outer rim a plurality of openings, each of the plurality of openings sized to receive a test tube; the plurality of openings surrounding and connected to a central hub, the central hub including a hole extending through the central hub; each of the plurality of openings having a top end, the top end including at least one raised portion and at least one lowered portion; and the outer rim having an inner diameter permitting the outer rim to fit over a rim of a vessel, thereby allowing for suspension of a test tube received in one of the openings inside the vessel.

In another embodiment the invention is a test tube rack for suspending a plurality of test tubes inside a vessel comprising: a unitary structure including an outer rim and interior to the outer rim a plurality of openings, each of the plurality of openings sized to receive a test tube; the plurality of openings surrounding and connected to a central hub; each of the plurality of openings having a top end, the top end including at least one raised portion and at least one lowered portion; at least one cross member connected to the outer rim wherein the outer rim extends below the at least one cross member and the openings extend both above and below the at least one cross member; and the outer rim having an inner diameter permitting the outer rim to fit over a rim of a vessel, thereby allowing for suspension of a test tube received in one of the openings inside the vessel.

In one embodiment, disclosed is a one piece test tube rack comprising: an outer rim with an internal diameter sized to fit over a rim of a vessel; a plurality of openings, each sized to fit a test tube; a top end of each of the openings having at least one raised portion and at least one lowered portion forming a discontinuous rim; and a central hub joining the plurality of openings together.

These and other features and advantages of this disclosure will become more apparent to those skilled in the art from the detailed description of a preferred embodiment. The drawings that accompany the detailed description are described below.

DETAILED DESCRIPTION OF A PREFERRED EMBODIMENT

Figure 1:
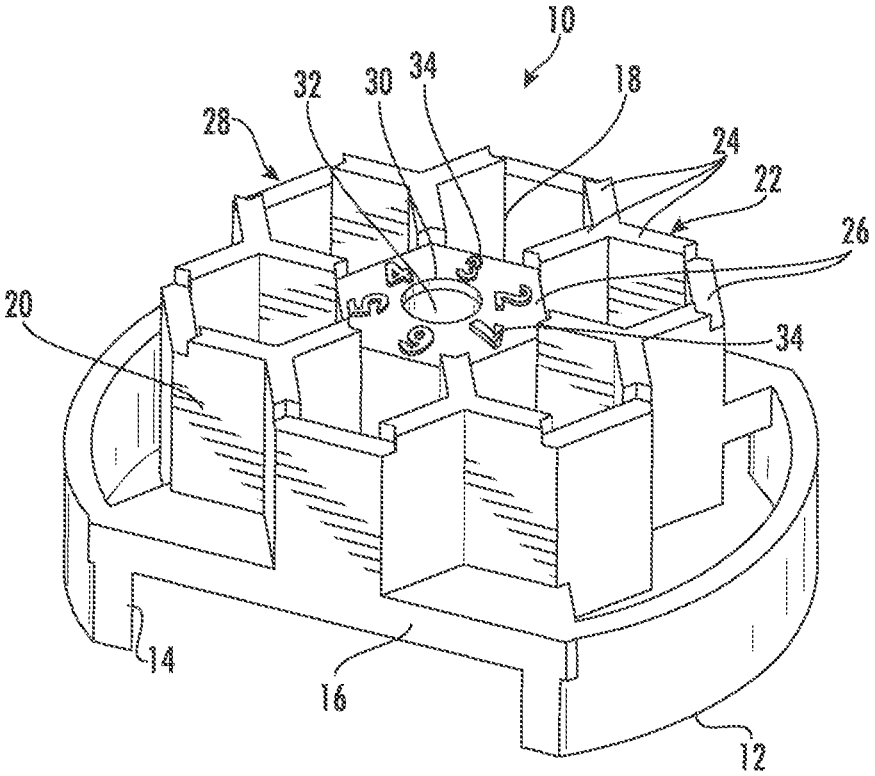
FIG. 1 is a perspective view of a test tube rack designed in accordance with the present disclosure.

One embodiment of a test tube rack according to the present disclosure is shown generally at 10 in FIG. 1. The test tube rack 10 is a unitary single piece design and includes an outer rim 12 that has an internal diameter that is sized to fit over a rim of a vessel as described herein below. The outer rim 12 can be continuous or more preferably discontinuous with one or more gaps 14 in the outer rim 12 as shown in FIG. 1. If the outer rim 12 is discontinuous as shown in FIG. 1 the test tube rack 10 includes at least one cross member 16 joining the parts of the discontinuous outer rim 12 together. Preferably as shown the outer rim 12 extends below the at least one cross member 16. The test tube rack 10 includes a plurality of openings 18 sized to fit a test tube, shown in FIG. 6. Each of the openings 18 is preferably formed from a plurality of joined walls 20 as shown. In the figures the walls 20 form a hexagonal shape, however any shape could be utilized. For example, the openings 18 can also comprise a cylindrical shape, not shown, with a single continuous circular wall or they could be a mixture of different shapes. As shown, the openings 18 extend above the cross member 16 and each has a top end 22 with the top end 22 of each opening 18 including a plurality of raised portions 24 and plurality of lowered portions 26, thereby forming a discontinuous rim 28. A central hub 30 joins the plurality of openings 18 together and serves to form one of the walls 20 for each of the openings 18 as shown. In the embodiment wherein the openings 18 are cylindrical the central hub 30 would also be integral with the cylindrical wall forming each opening 18 as would be understood by one of skill in the art. The central hub 30 includes a hole 32 and a plurality of different indicia marks 34 adjacent to the top ends 22 of the openings 18. The hole 32 permits a probe, not shown, to be held in the test tube rack 10 and to thereby extend into a vessel 40, 140, 150 that the test tube rack 10 is mounted onto. As is known in the art, a probe can be inserted through a hole in a rubber stopper, not shown, and then the rubber stopper with probe can be inserted into the hole 32 to secure the probe in place. The probe can be used to monitor a variety of features of a fluid, 60, in a vessel 40, 140, 150. These features could include temperature, pH or other features desired to be monitored. The different indicia marks 34 are shown as numbers but they could be any other set of distinct symbols such as letters or other non-alphabetic symbols. Each indicia mark 34 is different from the others so as to allow a user to identify each opening 18 and or the test tube in a given opening 18. The top end 22 of each opening 18 has at least one raised portion 24 and at least one lowered portion 26, however it is preferable that it have multiple raised portions 24 and lowered portions 26 as shown.

Figure 2:
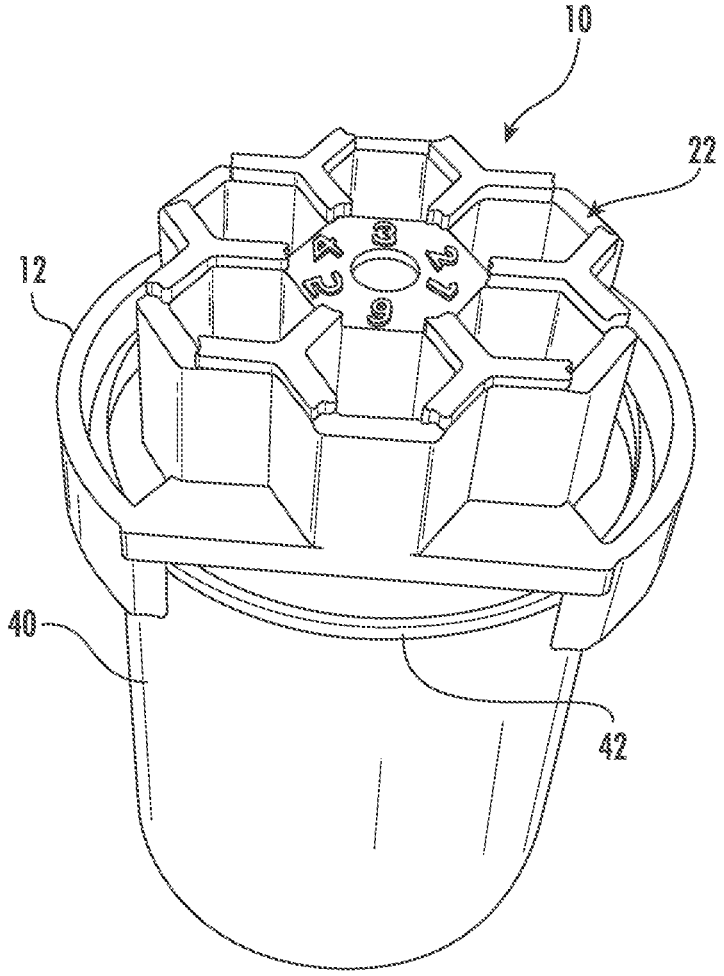
FIG. 2 is a perspective view of the test tube rack from FIG. 1 shown mounted on a vessel.
Figure 5:
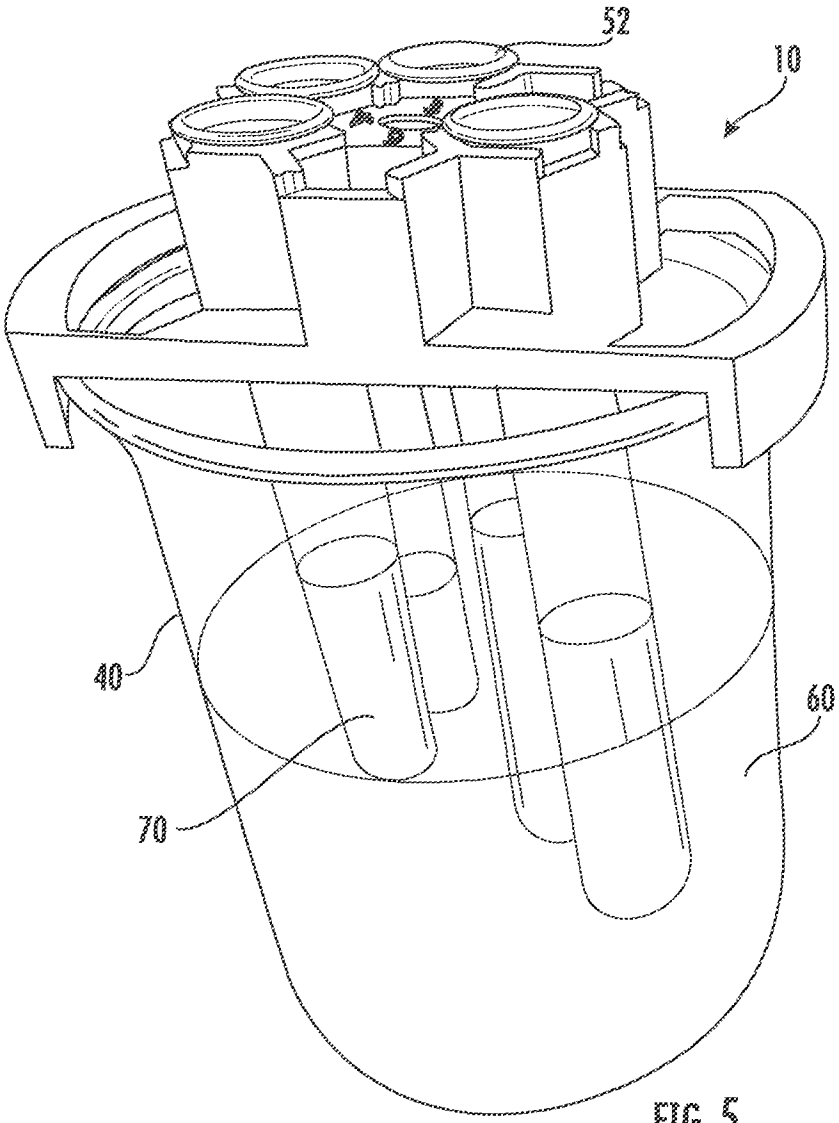
FIG. 5 is a side perspective view of the test tube rack of FIG. 3 mounted on top of a vessel and holding a plurality of test tubes in a fluid in the vessel.

As shown in FIG. 2 a vessel 40, in this figure a standard laboratory beaker, having a rim 42 can serve as a bath once a fluid, see FIG. 5, has been added to the vessel 40. The present invention can be utilized in any vessel having a rim. As is known to one of skill in the art, the dimensions of the outer rim 12 and the number of openings 18 can be adjusted to fit, for example only, standard laboratory beakers having capacities of from 100 milliliters to 1 liter or even larger if desired. The outer rim 12 of the rack 10 has an internal diameter that is sized to fit over the rim 42 of the vessel 40 and thus securely holds the test tube rack 10 in position above the rim 42 of the vessel 40. The top ends 22 of each opening 18 are located above the rim 42 of the vessel 40 when the test tube rack 10 is positioned on the rim 42.

Figure 3:
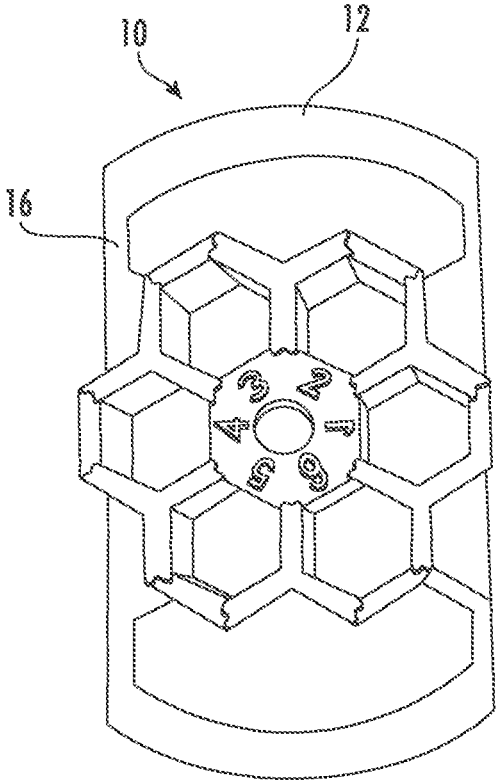
FIG. 3 is a top view of a second test tube rack according to the present disclosure designed to fit a larger vessel than the test tube rack shown in FIG. 1.
Figure 4:
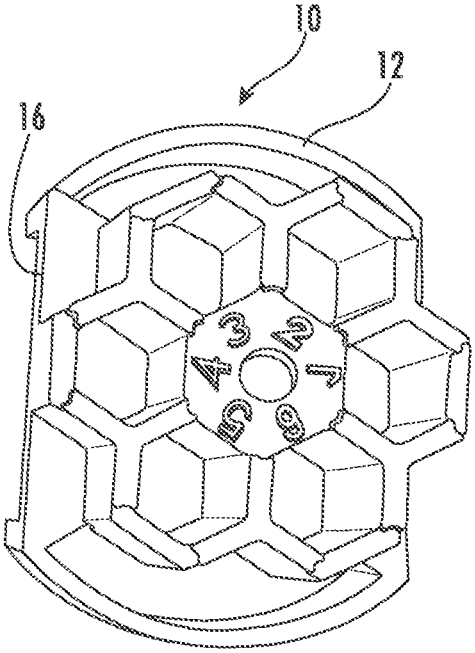
FIG. 4 is a top view of the test tube rack shown in FIG. 1.

FIG. 3 and FIG. 4 show top views of two test tube racks 10 in accordance with the present disclosure. The test tube rack 10 shown in FIG. 3 is designed to fit over a rim 42 of a larger vessel 40 than the test tube rack 10 shown in FIG. 4. In FIG. 3 the outer rim 12 has a larger internal diameter compared to the internal diameter of the outer rim 12 in FIG. 4 and the cross members 16 are longer in FIG. 3 compared to the design shown in FIG. 4. Other than these features the test tube rack 10 in FIG. 3 has all the same features as the test tube rack 10 in FIGS. 1, 2 and 4 as described herein.

Figure 6:
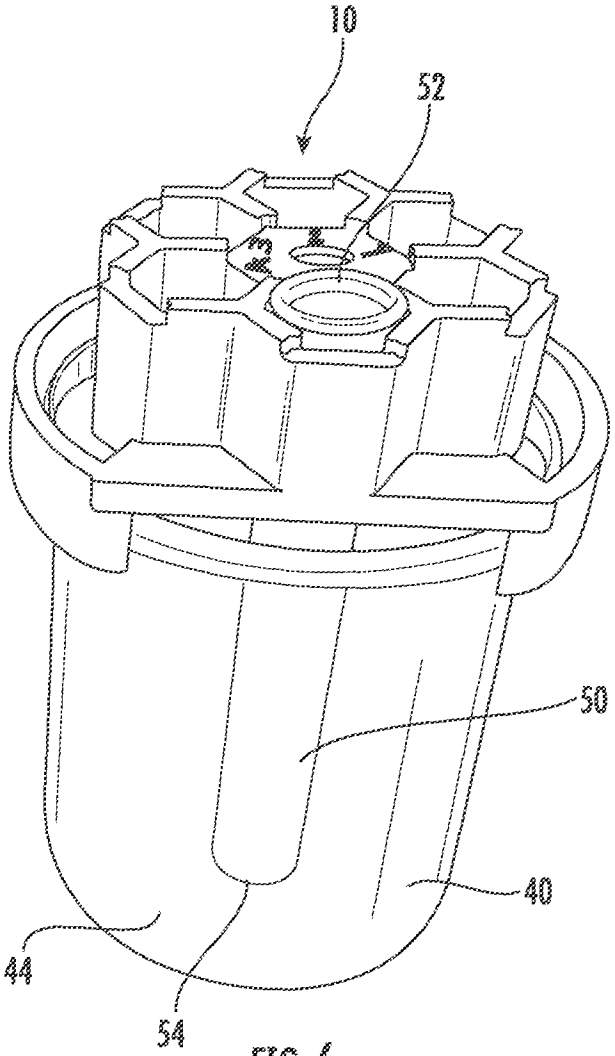
FIG. 6 is a side perspective view of the test tube rack of FIG. 1 mounted on top of a vessel and holding a test tube in the vessel.

FIG. 5 and FIG. 6 show the test tube racks 10 from FIG. 3 and FIG. 4, respectively, each mounted on top of a vessel 40. The vessels 40 are standard laboratory beakers of different sizes, for example 250 milliliter, 500 milliliter or 1 liter beakers as are known in the art. Each test tube rack 10 is shown with one or more test tubes 50 mounted in the openings 18 of the test tube rack 10. Each test tube 50 shown has an outwardly flared top rim 52 that is supported by the raised portions 24 of each opening 18 as shown. The raised portions 24 and lowered portions 26 form the discontinuous rim 28 which permits a user to easily grip the outwardly flared top rim 52 to remove or place a test tube 50 into an opening 18. As shown the test tube rack 10 keeps the outwardly flared top rim 52 of the test tube 50 above the level of the rim 42 of the vessel 40 thereby preventing a fluid 60 in the vessel 40 from entering the test tube 50. For illustrative purposes a fluid 70 is also shown in each of the test tubes 50 in FIG. 5. As can be seen the test tube rack 10 suspends the test tubes 50 securely in the vessel 40 and keeps a bottom 54 of the test tube 50 from contacting a bottom 44 of the vessel 40. Thus, the fluid 60 can freely circulate around the outside of the test tube 50 in the vessel 40. The test tube rack 10 can also be used with test tubes that do not have an outwardly flared rim. Some test tubes are designed with a cylindrical wall that is the same diameter throughout except at the closed bottom of the test tube. When using these sorts of test tubes in the present test tube rack one merely places a rubber band or an O-ring at the top of the test tube to serve the same function as the outwardly flared rim 52 in holding the test tube 50 suspended in the test tube rack 10. Thus, the present design can also function with rimless test tubes.

Figure 7:
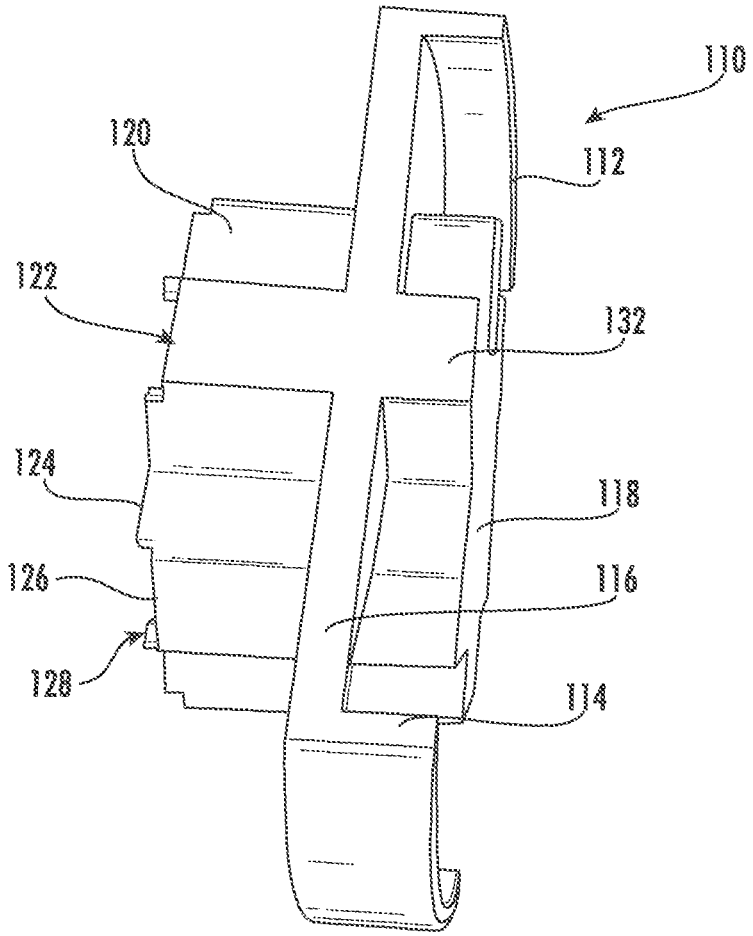
FIG. 7 is a side perspective view of an alternative embodiment of a test tube rack according to the present disclosure.
Figure 8:
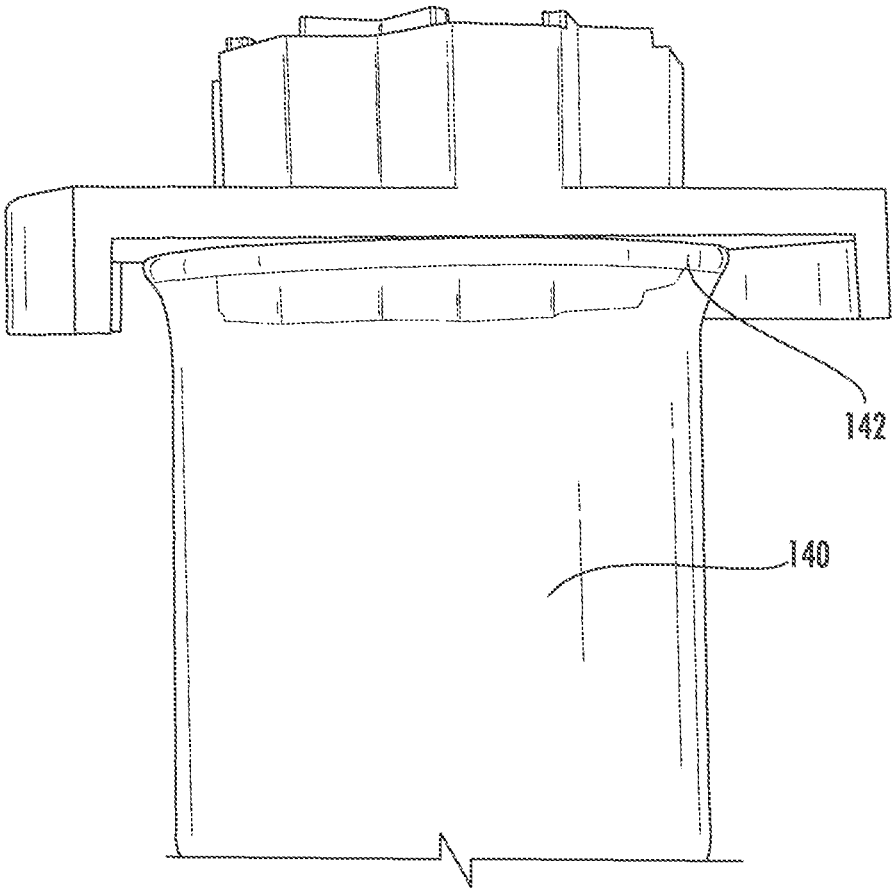
FIG. 8 is a is a side perspective view of the alternative embodiment test tube rack of FIG. 7 mounted on top of a vessel having a size of 250 milliliters.
Figure 9:
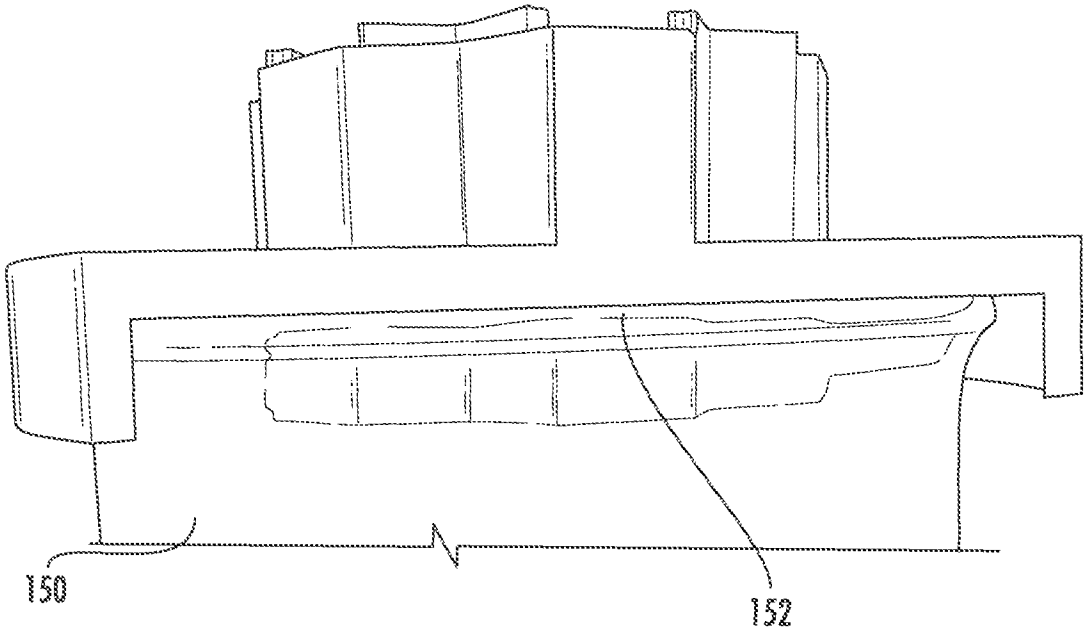
FIG. 9 is a is a side perspective view of the alternative embodiment test tube rack of FIG. 8 mounted on top of a vessel having a size of 500 milliliters.

An alternative embodiment of a test tube rack according to the present disclosure is shown generally at 110 in FIG. 7. This embodiment has all the features of the embodiments described before and includes an additional feature. The test tube rack 110 is a unitary single piece design and includes an outer rim 112 that has an internal diameter that is sized to fit over a rim of a vessel as described herein. The outer rim 112 can be continuous or more preferably discontinuous with one or more gaps 114 in the outer rim 112 as shown in FIG. 7. If the outer rim 112 is discontinuous as shown in FIG. 7 the test tube rack 110 includes at least one cross member 116 joining the parts of the discontinuous outer rim 112 together. The test tube rack 110 includes a plurality of openings 118 sized to fit a test tube. Each of the openings 118 is preferably formed from a plurality ofjoined walls 120 as shown. Alternatively, an opening 118 can also comprise a cylindrical shape, not shown, with a single continuous circular wall. A top end 122 of each opening 118 includes a plurality of raised portions 124 and plurality of lowered portions 126 forming a discontinuous rim 128. A central hub with a hole and indicia marks, not shown but as in the other embodiments, joins the plurality of openings 118 together and serves to form one of the walls 120 for each of the openings 118. In the embodiment wherein the openings 118 are cylindrical the central hub would also be integral with the cylindrical wall forming each opening 118 as would understood by one of skill in the art. The top end 122 of each opening 118 has at least one raised portion 124 and at least one lowered portion 126, however it is preferably that it have multiple raised portions 124 and lowered portions 126 as shown. In this embodiment the openings 118 include the additional feature of a bottom end 132 that extends below the cross member 116 to a distance approximately equal with the outer rim 112 as shown in addition to the top end 122 which extends above the cross member 116. This extended bottom end 132 allows a single sized test tube rack 110 to be used in multiple sized vessels 140 as shown in FIGS. 8 and 9. As shown in FIG. 8 the test tube rack 110 can be placed on top of a vessel 140 having a rim 142 as shown. In this embodiment the vessel 140, for example a 250 milliliter beaker, accommodates the bottom ends 132 inside the rim 142. The extended bottom ends 132 of the openings 118 prevent the test tube rack 110 from sliding around in the vessel 140 because they are spaced closely adjacent to an inside wall of the vessel 140 as shown. The same test tube rack 110 can also be used in a much larger vessel 150 as shown in FIG. 9. In this example, for instance, the vessel 150 is 500 milliliters in volume and in this embodiment the outer rim 112 is closely adjacent to the rim 152 of the vessel 150 thereby preventing the test tube rack 110 from sliding around when placed on top of the vessel 150. Thus, the same test tube rack 110 can be used in several different sized vessels 140 and 150 while being stable in each size vessel because of the interaction of the components of the test tube rack 110 with the vessel 140 and 150.

The test tube rack 10, 110 can be formed from any temperature resistant material, preferably a plastic, a polymeric material, a metal or mixtures thereof. The term temperature resistant material means the material can withstand temperatures of from less than 0° C. to greater than 100° C., and more preferably from −200° C. to 250° C., most preferably from −80° C. to 150° C. The desired temperature operating range will determine in part the suitability of the material chosen. In one embodiment the test tube rack 10, 110 is formed from a plastic using a 3d printer. The test tube rack 10, 110 is economical to produce and the internal diameter of the outer rim 12, 112 can be sized to fit any size rim 42, 142, 152 of any vessel 40, 140, 150. Such as, for example, vessels having a size capable of holding up to 100 milliliters or vessels large enough to hold up to 1 liter. As the diameter of the vessel increases one will also be able to increase the number of test tubes that can be held in the test tube rack as its size will also increase. The openings 18, 118 can have any desired diameter to accommodate any diameter test tube and they can be arranged in any desired pattern that will fit within the outer rim 12, 112 while still allowing the outer rim 12, 112 to fit over the rim 42, 142, 152 of the vessel 40, 140, 150. Although, for illustrative purposes, the vessels 40, 140, 150 are shown as being laboratory beakers, the vessels 40, 140, 150 are not limited to these structures and can comprise any structures or shapes.

In one embodiment the invention comprises a test tube rack for suspending a plurality of test tubes inside a vessel comprising: a unitary structure including an outer rim and interior to the outer rim a plurality of openings, each of the plurality of openings sized to receive a test tube; the plurality of openings surrounding and connected to a central hub; each of the plurality of openings having a top end, said top end including at least one raised portion and at least one lowered portion; and the outer rim having an inner diameter permitting the outer rim to fit over a rim of a vessel, thereby allowing for suspension of a test tube received in one of the openings inside the vessel. The outer rim can be formed from a plurality of discontinuous segments wherein the discontinuous segments are joined to each other by at least one cross member. The outer rim can extend below the at least one cross member and the plurality of openings can extend above the at least one cross member. Preferably, the openings also extend below the at least one cross member. The central hub can further include a hole extending through the central hub. The central hub can further include an indicia mark adjacent to each of the top ends of each of the openings. The openings can have a shape selected from the group consisting of a cylindrical shape, a hexagonal shape, or mixtures thereof. In some embodiments the outer rim has an inner diameter sufficient to permit it to fit over a rim of a vessel having a capacity of from 100 milliliters to 1 liter. Preferably the test tube rack is formed from a temperature resistant material able to withstand temperatures of from less than 0° C. to greater than 100° C., and more preferably from −200° C. to 250° C., most preferably from −80° C. to 150° C. The temperature resistant material is preferably selected from the group consisting of a plastic, a polymeric material, a metal and mixtures thereof.

In another embodiment the invention is a test tube rack for suspending a plurality of test tubes inside a vessel comprising: a unitary structure including an outer rim and interior to the outer rim a plurality of openings, each of the plurality of openings sized to receive a test tube; the plurality of openings surrounding and connected to a central hub, the central hub including a hole extending through the central hub; each of the plurality of openings having a top end, the top end including at least one raised portion and at least one lowered portion; and the outer rim having an inner diameter permitting the outer rim to fit over a rim of a vessel, thereby allowing for suspension of a test tube received in one of the openings inside the vessel. In an embodiment the outer rim is formed from a plurality of discontinuous segments and the discontinuous segments are joined to each other by at least one cross member. The outer rim can extend below the at least one cross member and the plurality of openings can extend above the at least one cross member. The openings can also extend below the at least one cross member. The central hub can further include an indicia mark adjacent to each of the top ends of each of the openings. The openings can have a shape selected from the group consisting of a cylindrical shape, a hexagonal shape, or mixtures thereof. The outer rim can have an inner diameter sufficient to permit it to fit over a rim of a vessel having a capacity of from 100 milliliters to 1 liter. The test tube rack is preferably formed from a temperature resistant material able to withstand temperatures of from less than 0° C. to greater than 100° C., and more preferably from −200° C. to 250° C., most preferably from −80° C. to 150° C. The temperature resistant material preferably is selected from the group consisting of a plastic, a polymeric material, a metal and mixtures thereof.

In another embodiment the invention is a test tube rack for suspending a plurality of test tubes inside a vessel comprising: a unitary structure including an outer rim and interior to the outer rim a plurality of openings, each of the plurality of openings sized to receive a test tube; the plurality of openings surrounding and connected to a central hub; each of the plurality of openings having a top end, the top end including at least one raised portion and at least one lowered portion; at least one cross member connected to the outer rim wherein the outer rim extends below the at least one cross member and the openings extend both above and below the at least one cross member; and the outer rim having an inner diameter permitting the outer rim to fit over a rim of a vessel, thereby allowing for suspension of a test tube received in one of the openings inside the vessel.

The foregoing disclosure has been described in accordance with the relevant legal standards, thus the description is exemplary rather than limiting in nature. Variations and modifications to the disclosed embodiment may become apparent to those skilled in the art and do come within the scope of the disclosure. Accordingly, the scope of legal protection afforded this disclosure can only be determined by studying the following claims.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

We claim:

1. A test tube rack for suspending a plurality of test tubes inside a vessel comprising:

a one piece unitary structure including an outer rim and interior to said outer rim a plurality of openings, each of said plurality of openings having an open bottom and being sized to receive a test tube;

said plurality of openings surrounding and connected to a central hub;

each of said plurality of openings having a top end, said top end formed as a discontinuous rim and including at least one raised portion and at least one lowered portion relative to said raised portion thereby forming said discontinuous rim;

said outer rim being formed from a plurality of discontinuous curved segments joined to each other by a plurality of cross members, wherein each of said curved segments includes a flange that extends below said plurality of cross members; and said flanges of said curved segments spaced apart from each other to form an inner diameter permitting said flanges to fit over a rim of a separate vessel, thereby allowing for suspension of a test tube received in one of said openings inside the vessel.

2. The test tube rack as recited in claim 1 wherein said plurality of openings extend above said plurality of cross members.

3. The test tube rack as recited in claim 1 wherein said openings extend below said plurality of cross members.

4. The test tube rack as recited in claim 1 wherein said central hub further includes a unique indicia mark adjacent to said top end of each of said openings.

5. The test tube rack as recited in claim 1 wherein said openings have a shape selected from the group consisting of a cylindrical shape, a hexagonal shape, or mixtures thereof.

6. The test tube rack as recited in claim 1 wherein said flanges of said curved segments form an inner diameter sufficient to permit it to fit over a rim of a vessel having a capacity of from 100 milliliters to 1 liter.

7. The test tube rack as recited in claim 1 wherein said test tube rack is formed from a temperature resistant material that is resistant to temperatures ranging from −200° C. to 250° C.

8. The test tube rack as recited in claim 7 wherein the temperature resistant material is selected from the group consisting of a plastic, a non-plastic polymeric material, a metal and mixtures thereof.

9. A test tube rack for suspending a plurality of test tubes inside a vessel comprising:

a one piece unitary structure including an outer rim and interior to said outer rim a plurality of openings, each of said plurality of openings having an open bottom and being sized to receive a test tube;

said plurality of openings surrounding and connected to a central hub, said central hub including a through hole passing completely through said central hub;

each of said plurality of openings having a top end, said top end formed as a discontinuous rim and including at least one raised portion and at least one lowered portion relative to said raised portion thereby forming said discontinuous rim;

said outer rim being formed from a plurality of discontinuous curved segments joined to each other by a plurality of cross members, wherein each of said curved segments includes a flange that extends below said plurality of cross members; and said flanges of said curved segments spaced apart from each other to form an inner diameter permitting said flanges to fit over a rim of a separate vessel, thereby allowing for suspension of a test tube received in one of said openings inside the vessel.

10. The test tube rack as recited in claim 9 wherein said plurality of openings extend above said plurality of cross members.

11. The test tube rack as recited in claim 10 wherein said openings also extend below said plurality of cross members.

12. The test tube rack as recited in claim 9 wherein said central hub further includes a unique indicia mark adjacent to said top end of each of said openings.

13. The test tube rack as recited in claim 9 wherein said openings have a shape selected from the group consisting of a cylindrical shape, a hexagonal shape, or mixtures thereof.

14. The test tube rack as recited in claim 9 wherein said flanges of said curved segments form an inner diameter sufficient to permit said flanges to fit over a rim of a vessel having a capacity of from 100 milliliters to 1 liter.

15. The test tube rack as recited in claim 9 wherein said test tube rack is formed from a temperature resistant material that is resistant to temperatures ranging from −200° C. to 250° C.

16. The test tube rack as recited in claim 15 wherein the temperature resistant material is selected from the group consisting of a plastic, a non-plastic polymeric material, a metal and mixtures thereof.

17. A test tube rack for suspending a plurality of test tubes inside a vessel comprising:

a one piece unitary structure including an outer rim and interior to said outer rim a plurality of openings, each of said plurality of openings having an open bottom and being sized to receive a test tube;

said plurality of openings surrounding and connected to a central hub;

each of said plurality of openings having a top end, said top end formed as a discontinuous rim and including at least one raised portion and at least one lowered portion relative to said raised portion thereby forming said discontinuous rim;

said outer rim being formed from a plurality of discontinuous curved segments joined to each other by a plurality of cross members, wherein each of said curved segments includes a flange that extends below said plurality of cross members and said openings extend both above and below said plurality of cross members; and said flanges of said curved segments spaced apart from each other to form an inner diameter permitting said flanges to fit over a rim of a separate vessel, thereby allowing for suspension of a test tube received in one of said openings inside the vessel.

* * * * *